US005463960A

United States Patent [19]

Lowry

[11] Patent Number: 5,463,960

[45] Date of Patent: Nov. 7, 1995

[54] STREAMLINED BULLET

[76] Inventor: Charles P. Lowry, R.D. #1, Box 38, Cooperstown, Pa. 16317

[21] Appl. No.: 378,492

[22] Filed: Jan. 26, 1995

[51] Int. Cl.[6] ..... F42B 10/00

[52] U.S. Cl. ..... 102/501; 102/514; 102/524

[58] Field of Search ..... 102/439, 501, 102/514–518, 524, 526, 527, 490

[56] References Cited

U.S. PATENT DOCUMENTS

| | | | |
|---|---|---|---|
| 69,707 | 10/1867 | Rupertus . | |
| 802,301 | 10/1905 | Michele . | |
| 1,043,547 | 11/1912 | Stanbridge . | |
| 1,075,202 | 10/1913 | Fidjeland . | |
| 2,938,458 | 5/1960 | O'Brien | 102/38 |
| 3,873,048 | 3/1975 | Platou | 244/3.1 |
| 4,005,660 | 2/1977 | Pichard | 102/92.1 |
| 4,251,079 | 2/1981 | Earl et al. | 273/428 |
| 4,616,568 | 10/1986 | Serge | 102/501 |
| 5,103,736 | 4/1992 | Sowash | 102/501 |

FOREIGN PATENT DOCUMENTS

| | | | |
|---|---|---|---|
| 66392 | 3/1948 | Denmark | 102/514 |
| 721585 | 3/1932 | France | 102/439 |
| 116856 | 7/1946 | Sweden | 102/517 |
| 130405 | 8/1919 | United Kingdom | 102/501 |

*Primary Examiner*—Harold J. Tudor
*Attorney, Agent, or Firm*—Lovercheck and Lovercheck

[57] ABSTRACT

A bullet for a rifle. The bullet having a nose, a cylindrical body surface, a rotating band section spaced from the cylindrical body surface. A streamlined section disposed between the rotating band section and the cylindrical body surface. The streamlined section is made up of a frustoconical front section, an apex and a base having a base joining the cylindrical body section, a frustoconical rear section having an apex joining the apex of the frustoconical front section and the frustoconical rear section having a base joining the rotating band section and a boat tail bullet. The streamlined part of the bullet improves the range, stability, velocity and trajectory of the bullet. A machine is disclosed for manufacturing the bullet.

1 Claim, 7 Drawing Sheets

STREAMLINED BULLET

BACKGROUND OF THE INVENTION

This invention involves a basic jacketed rifle bullet with a conventional ogive and boat tail with the addition of a streamlining profile just forward of the rear groove diameter.

This stream lining provides a more sustained velocity, therefore, a flatter trajectory, longer range and more stability. This invention is intended for use on all existing calibers of rifles, as well as new calibers, with various jackets, points, bullet weights, etc. New shell casings will be developed, along with the appropriate barrels, chambers, and magazines in rifles where indicated.

The bullet may be manufactured by a rolling process. An example of a hand operated bullet rolling mill suitable for making the bullet is disclosed in this application.

Applicant is aware of the following U.S. Pat. Nos.: 69,707; 802,301; 1,043,547; 1,075,202; 2,938,458; 3,873,048; 4,005,660; 4,251,079 and 4,616,568.

SUMMARY OF THE INVENTION

It is an object of the invention to provide a streamlined rifle bullet to improve the range and accuracy.

It is another object of the present invention to provide a streamlined profile adjacent the tail of a rifle bullet that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
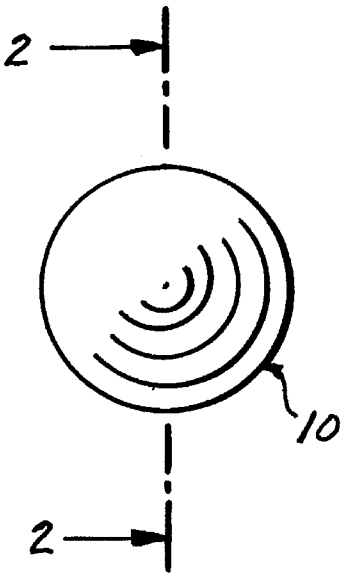
FIG. 1 is a front view of a bullet according to the invention.
Figure 2:
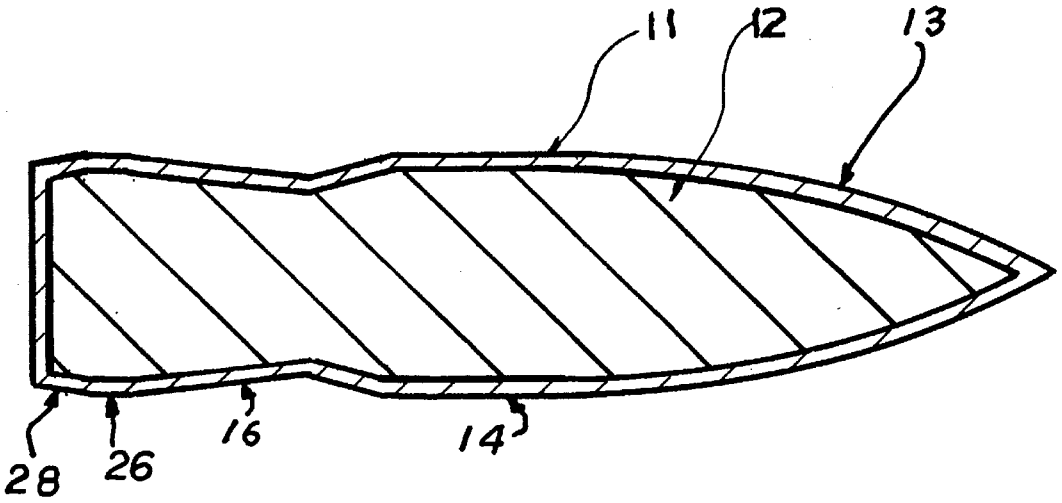
FIG. 2 is a cross sectional view taken on line 2—2 of FIG. 1.
Figure 3:
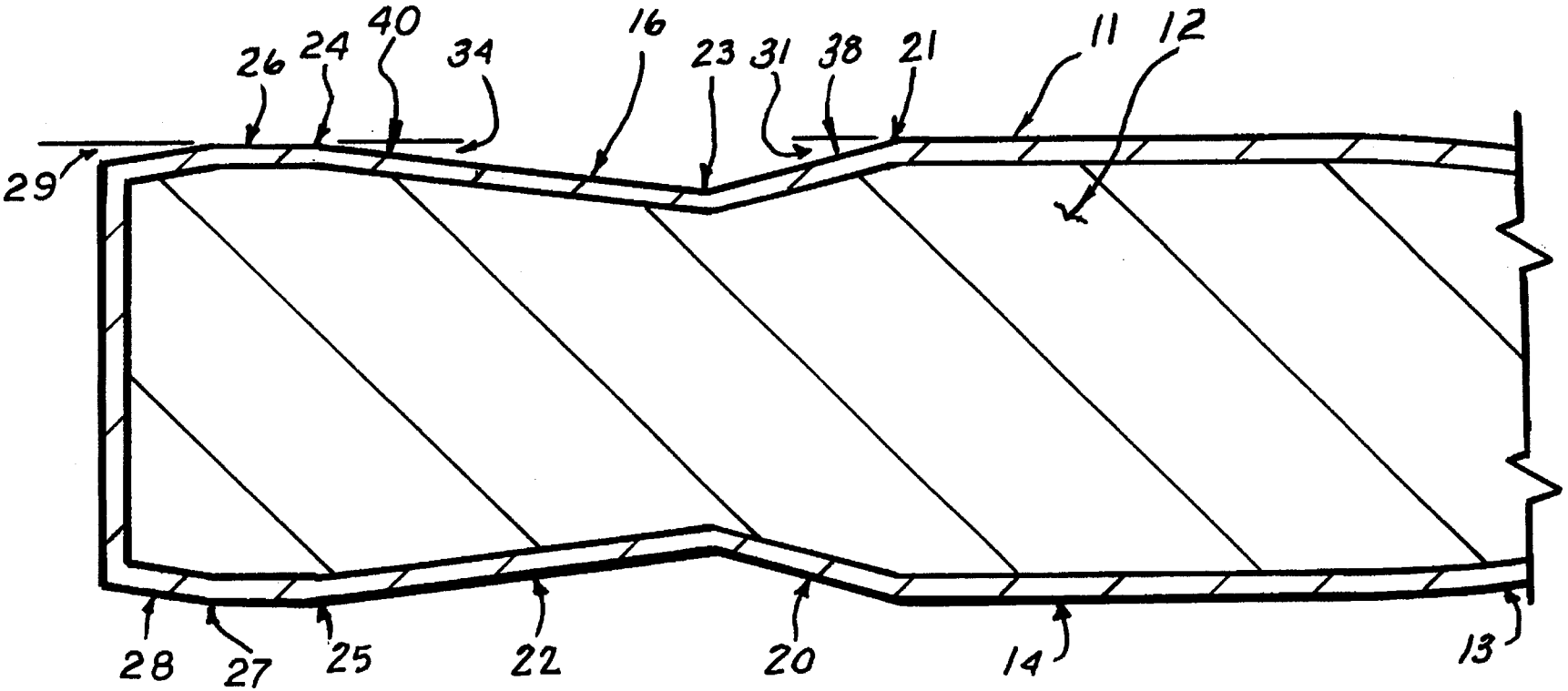
FIG. 3 is an enlarged partial view of FIG. 2.

Now with more particular reference to the drawings, shown is bullet 10 having jacket 11 and core 12. Core 12 may be made of a harder material than jacket 11. Bullet 10 has nose 13 and a body having cylindrical body surface 14 and streamline surface 16. Streamline surface 16 is attached to cylindrical body surface 14 at first position 21.

Streamline surface 16 is made up of front frustoconical surface 20, rear frustoconical surface 22 connected together at apex 23.

Front frustoconical surface 20 has base 38 connected to cylindrical body surface 14 at first position 21. Front frustoconical surface 20 inclines at first acute angle 31 of about fifteen degrees to cylindrical body surface 14. Rear frustoconical surface 22 has base 40 connected to rotating band 26. Rear frustoconical surface 22 inclines inward and toward front frustoconical surface 20 at second acute angle 34 of about seven degrees.

Rotating band surface 26 is cylindrical and joins boat tail surface 28 at fourth position 27. Boat tail surface 28 inclines rearwardly and inwardly at angle 29 of about nine degrees and may be shaped like the tail part of a conventional boat tail bullet and may be connected to rotating band surface 26.

Figure 4:
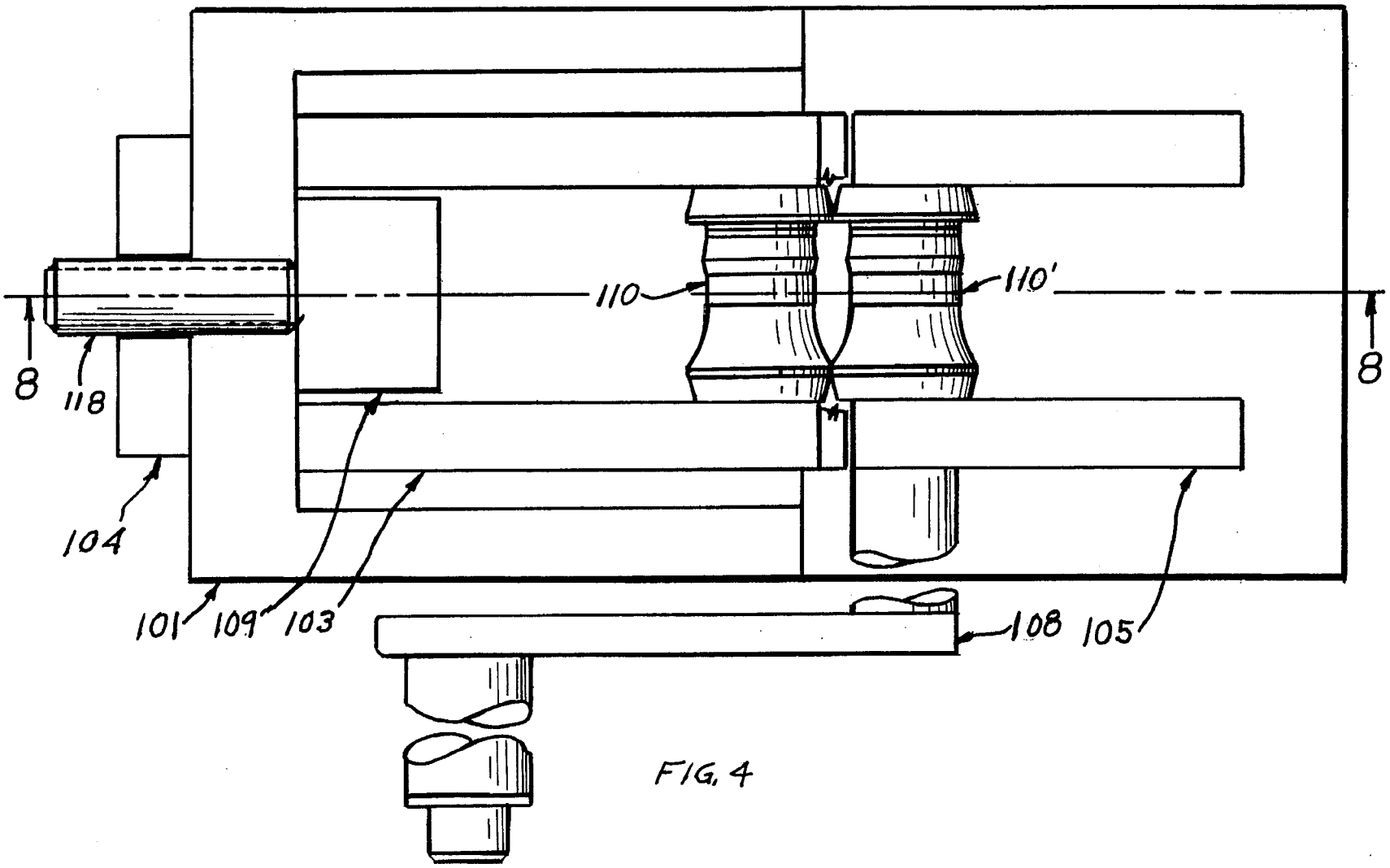
FIG. 4 is a top view of a bullet rolling mill for manufacturing the bullet according to the invention.
Figure 5:
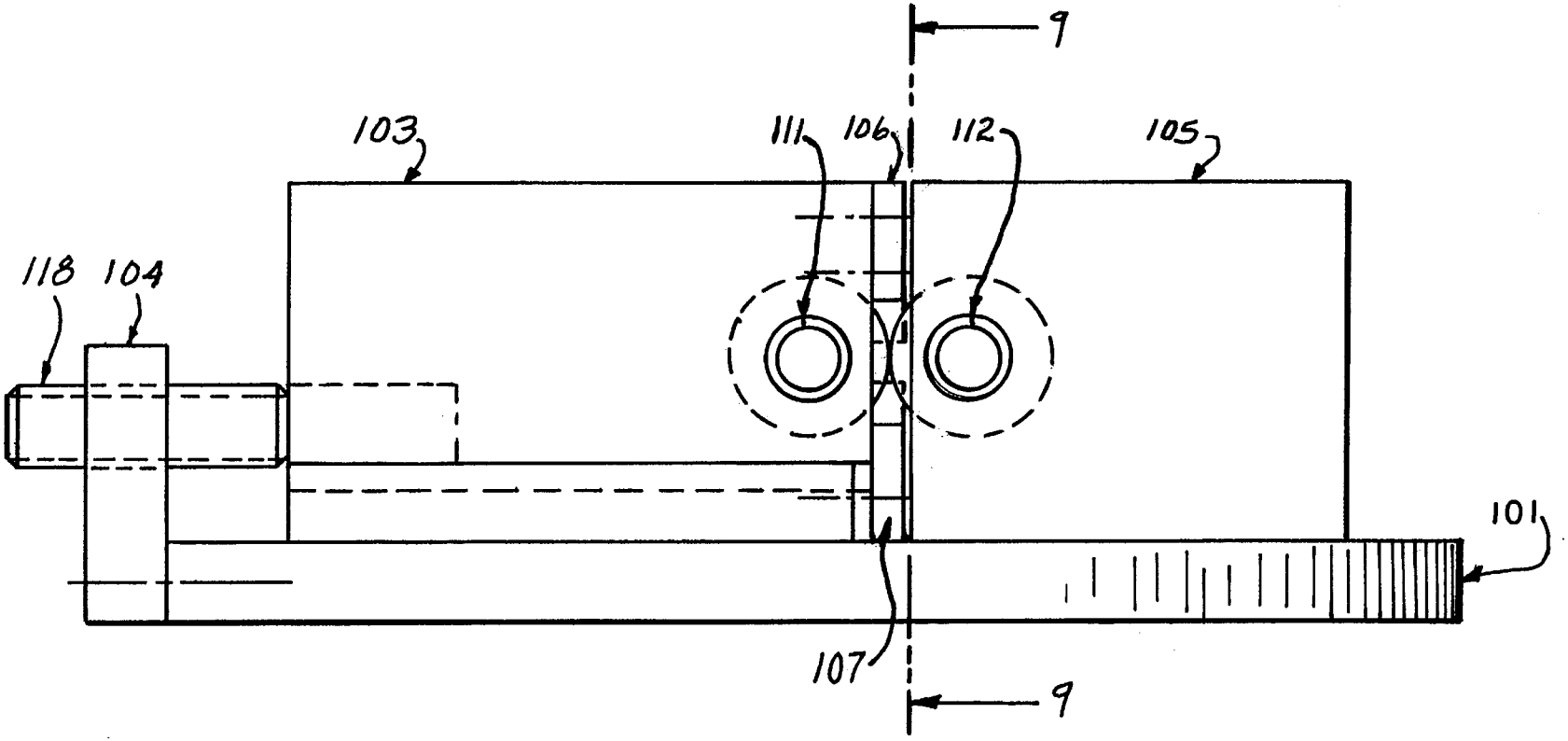
FIG. 5 is a side view of the rolling mill shown in FIG. 4.
Figure 7:
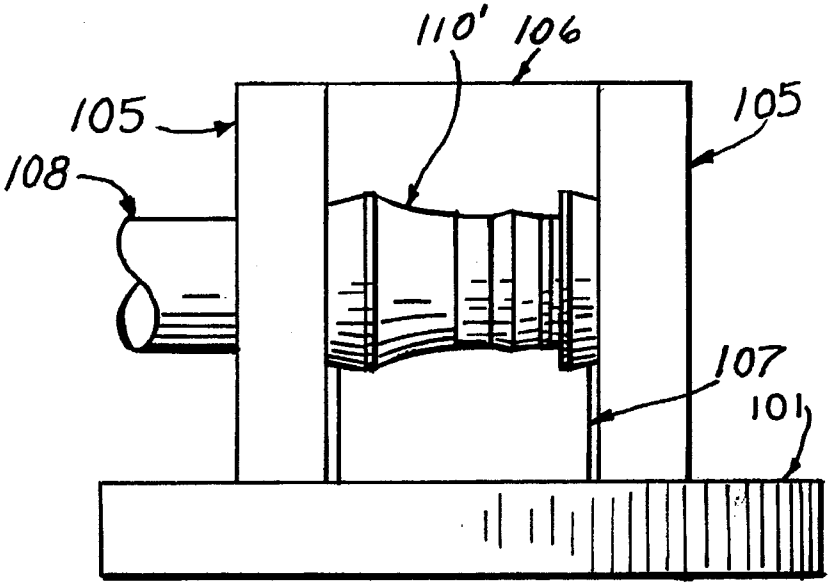
FIG. 7 is a right end view of the rolling mill.
Figure 6:
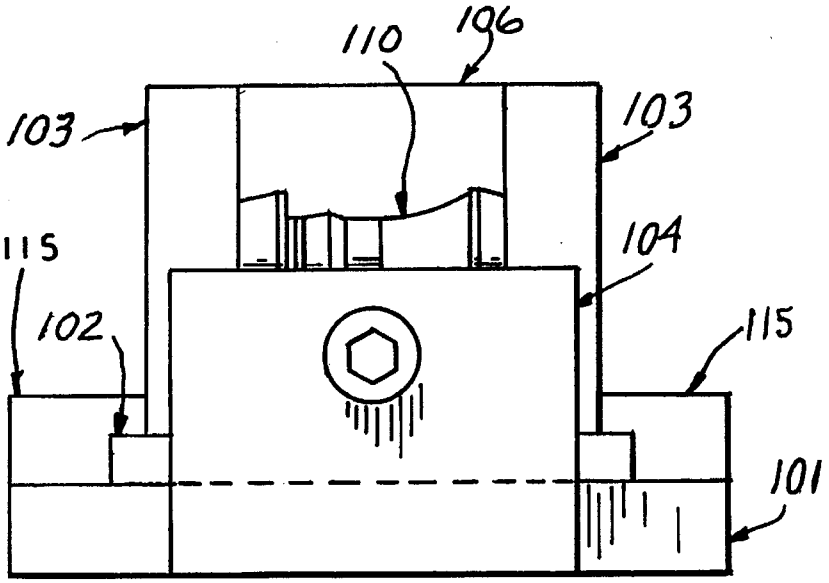
FIG. 6 is a left end view of the rolling mill.
Figure 8:
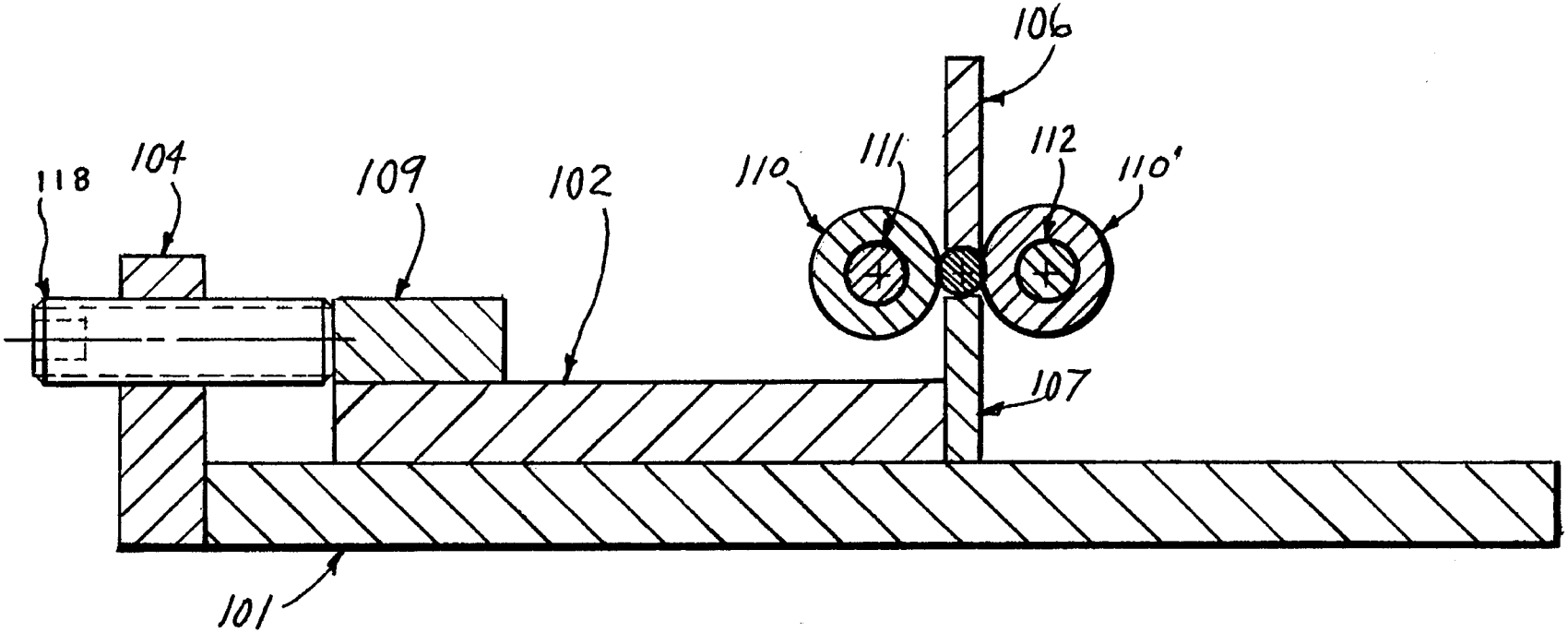
FIG. 8 is a cross sectional view taken on line 8—8 of FIG. 4.
Figure 9:
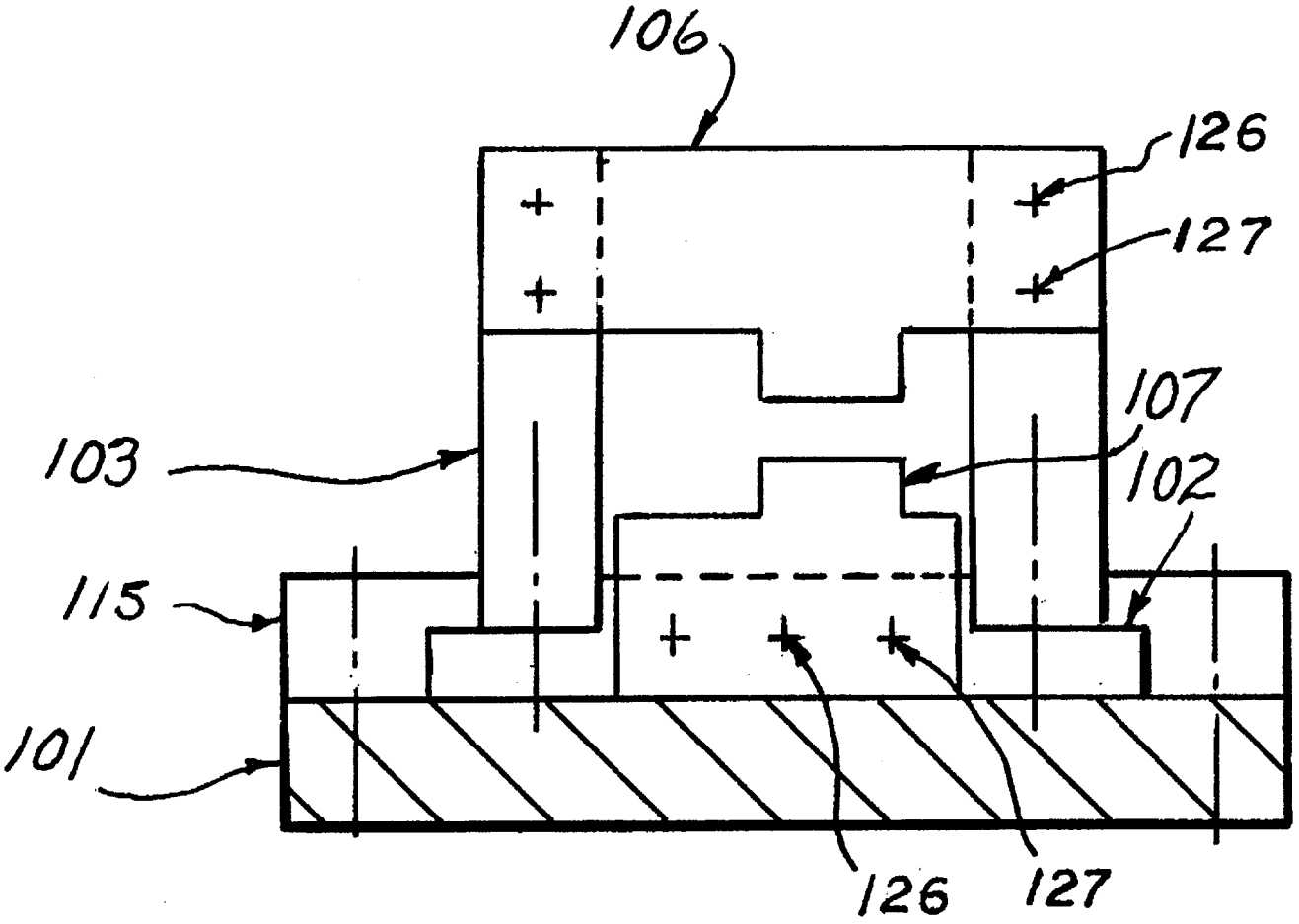
FIG. 9 is a cross sectional view taken on line 9—9 of FIG. 5.

Bullet 10 with a streamlined section like that described above can be made with a hand operated bullet rolling mill (as shown in FIGS. 4 through 8), designed for the fabrication of the streamlined bullet 10. Bullet 10 could not be withdrawn from a conventional bullet swaging die, nor can such a jacketed bullet be conventionally cast. Generally frustoconical front surface 20 and generally frustoconical rear surface 22 each have an axial length greater than the axial length of rotating band 26. The axial length of generally frustoconical rear surface 22 being longer than the axial length of generally frustoconical front surface 20.

The hand operated bullet rolling mill is designed for the fabrication of streamlined bullet 10 in order for streamline bullet 10 disclosed herein to be made available. Mass production of bullet 10, according to the invention, will be carried out in highly sophisticated automated machinery, whereby the copper tubing and lead wire will be automatically cut to length, assembled, rolled and unloaded.

Machine 100 is made up of a fixed assembly and a movable assembly. The stationary assembly is made up of base plate 101 with stationary roll frame members 105 fixed to base plate 101 in spaced relation to each other. Frame member 104 is fixed to base plate 101. Stationary roll 110' is supported on frame members 105. Lower work guide 107 is fixed to slide 102. Push block 109 is fixed to plate 102 and engaged by threaded screw 118, which is threadably received in frame member 104.

The traversing assembly is made up of traversing plate 102 which is slidably supported on base plate 101 and guided by slide gibs 115. Traversing frame members 103 are spaced laterally from one another and fixed to traversing plate 102. Roll 110 is rotatably supported on frame members 103. Upper guide plate 106 is fixed to frame members 103 adjacent roll 110.

In operation, an unformed bullet is supported on lower guide plate 107 against fixed roll 110'. Slide plate 102 is moved on base plate 101 bringing movable roll 110 into engagement with bullet 10. Screw 118 is tightened, bringing roll 110 into contact with bullet 10. Hand crank 108 is then rotated and screw 118 gradually tightened to form grooves on bullet 10. When the bullet is formed, screw 118 can be loosened and slide plate 102 can then be retracted manually by hand and streamlined bullet 10 removed from machine 100.

Movable roll 110 and stationary roll 110' have identical grooves in their outside peripheral surface thereof to shape streamlined surface 16 on bullet 10 to the streamlined shape shown herein.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A bullet having a cylindrical body;

a nose attached to said cylindrical body;

a streamline surface attached to an end of said cylindrical body;

said streamline surface comprising a generally frustoconical front surface and a generally frustoconical rear surface;

said generally frustoconical front surface having a base connected to an end of said cylindrical body surface;

said generally frustoconical rear surface having a base and an apex attached to an apex end of said generally frustoconical front surface;

said bullet has a generally cylindrical rotating band surface attached to said base of said frustoconical rear surface;

said bullet has a frustoconical boat tail having a base; and, and said generally cylindrical rotating band being connected to said base of said boat tail;

said generally frustoconical front surface and said generally frustoconical rear surface each having an axial length greater than the axial length of said rotating band;

said axial length of said frustoconical rear surface being greater than said axial length of said frustoconical front surface.

* * * * *